United States Patent [19]

Temple

[11] Patent Number: 5,016,028

[45] Date of Patent: May 14, 1991

[54] HIGH DENSITY MULTI-CHANNEL ARRAY, ELECTRICALLY PULSED DROPLET DEPOSITION APPARATUS

[75] Inventor: Stephen Temple, Cambridge, England

[73] Assignee: AM International, Inc., Chicago, Ill.

[21] Appl. No.: 421,426

[22] Filed: Oct. 13, 1989

[30] Foreign Application Priority Data

Oct. 13, 1988 [GB] United Kingdom ..... 8824014

[51] Int. Cl.[5] ..... B41J 2/045

[52] U.S. Cl. ..... 346/140 R; 310/333

[58] Field of Search ..... 346/140; 310/333

[56] References Cited

U.S. PATENT DOCUMENTS 4,752,788 6/1988 Yasuhara ..... 346/140
4,879,568 11/1989 Bartky ..... 346/140
4,887,100 12/1989 Michaelis ..... 346/140

*Primary Examiner*—Joseph W. Hartary
*Assistant Examiner*—Alrick Bobb

[57] ABSTRACT

A high density multi-channel array, electrically pulsed droplet deposition apparatus comprises a bottom sheet of piezoelectric material poled in a direction normal to said sheet and formed with a plurality of parallel channels mutually spaced in an array direction normal to the length of said channels. Each channel is defined by a pair of facing side walls and a bottom surface extending between the respective side walls. A top sheet facing said bottom surfaces of said channels and bonded to said side walls closes the channels at their tops. Each of at least some of the side walls include electrodes on opposite sides thereof to form shear mode actuators for effecting droplet expulsion from the channels associated with the actuators. Each electrode extends substantially along the length of the corresponding side wall and over an area from the edge of the side wall adjoining the top sheet which is so spaced from the bottom surface of the channel in which the electrode is disposed as to leave the portion of the bottom sheet adjacent the wall on which said electrode is provided substantially free from piezoelectric distortion when an electric field is applied across the electrodes of the associated wall.

15 Claims, 3 Drawing Sheets

HIGH DENSITY MULTI-CHANNEL ARRAY, ELECTRICALLY PULSED DROPLET DEPOSITION APPARATUS

CROSS REFERENCE TO RELATED APPLICATIONS

The present application is related to U.S. Pat. application Ser. Nos. 140,617, now U.S. Pat. No. 4,887,100 and 140,764, now U.S. Pat. No. 4,879,568 both filed Jan. 4, 1988, and both entitled "Droplet Deposition Apparatus" and to U.S. Pat. application Ser. No. 246,225, filed Sept. 19, 1988, and entitled "Multi-Disc Cutter and Method of Manufacture."

BACKGROUND OF THE INVENTION

The present invention relates generally to electrically pulsed, droplet deposition apparatus and more particularly to such apparatus in the form of a high density multi-channel array. A common use to which apparatus of this kind is put is as a drop-on-demand ink jet printhead.

A high density array printhead should clearly have the property that each channel can be actuated separately and that the energy applied to one channel is only minimally coupled into neighboring channels. Energy coupling between channels is often referred to as "crosstalk." In copending U.S. Pat. applications Ser. Nos. 140,764 now U.S. Pat. No. 4,879,568 and 140,617, now U.S. Pat. No. 4,887,100 both filed Jan. 4, 1988, and both entitled "Droplet Deposition Apparatus," there are disclosed ink jet printheads having a plurality of parallel channels mutually spaced in an array direction normal to the length of the channels. The printheads employ shear mode actuators, which occupy side walls of the channels, for expelling droplets from nozzles respectively communicating with the channels Shear mode actuators avoid one type of crosstalk; namely, crosstalk arising from volume changes in the actuators caused by elastic interaction from stress waves travelling through the piezoelectric material of the printhead. That is, shear mode actuators when actuated do not experience a volume change, for example, a change in length or height.

Actuation of two groups respectively of odd and even numbered channels in an alternate manner is a further feature of shared, shear mode wall actuators as disclosed in the previously mentioned copending application Ser. No. 140,617. In this type of system, the creation of a pressure p in a selected channel induces a pressure $-p/2$ in the immediate neighboring channels which therefore cannot be actuated at the same time as the selected channel. Pressure crosstalk, namely energy coupling into the neighboring channels of the same group, also occurs when compliant channel wall actuators of the selected channel are actuated. This can be avoided by the offset form of channel arrangement disclosed in application Ser. No. 140,617.

Although crosstalk reduction has been effected in the ways described for the forms of crosstalk referred to, a further source of crosstalk has been identified which is troublesome and requires a different approach to accomplish its reduction. The shear mode wall actuators of a printhead of the kind referred to, when actuated, are subject to respective fields normal to electrodes on opposite sides of the channel facing walls which comprise the actuators. These fields give rise to fringe fields which, in the vicinity of the roots of the wall actuators, have significant components parallel to the poling direction so that the piezoelectric material in these regions is volumetrically distorted rather than being deflected in shear. The overall effect of these fringe fields is to deflect the base material at the roots of the wall actuators to induce crosstalk into the neighboring channels and at the same time to reduce significantly the wall actuator deflection.

OBJECTS OF THE INVENTION

It is therefore a principal object of the present invention to provide a high density, multi-channel array, electrically pulsed droplet deposition apparatus which is characterized by reduced crosstalk between its channels.

It is a more specific object of the invention to provide a high density, multi-channel array, electrically pulsed droplet deposition apparatus in which crosstalk attributable to fringe field effects arising upon actuation of shear mode channel actuators is minimized.

Briefly, the present invention provides a high density, multi-channel array, electrically pulsed droplet deposition apparatus comprising a bottom sheet of piezoelectric material poled in a direction normal to the sheet and having a plurality of parallel channels mutually spaced in an array direction normal to the length of the channels and each defined by facing side walls and a bottom surface extending between the side walls. Electrodes are provided on opposite sides of each of at least some of the side walls to form shear mode actuators for effecting droplet expulsion from the channels associated with the actuators. Each electrode extends substantially along the length of the corresponding side wall and is spaced from the bottom surface of the channel so as to leave the bottom sheet adjacent the respective actuator substantially free from piezoelectric distortion when an electric field is applied across the electrodes of the wall.

BRIEF DESCRIPTION OF THE DRAWINGS

The foregoing objects and other advantages of the invention will be apparent on reading the following description in conjunction with the drawings, in which.

DESCRIPTION OF THE PREFERRED EMBODIMENTS

Figure 1:
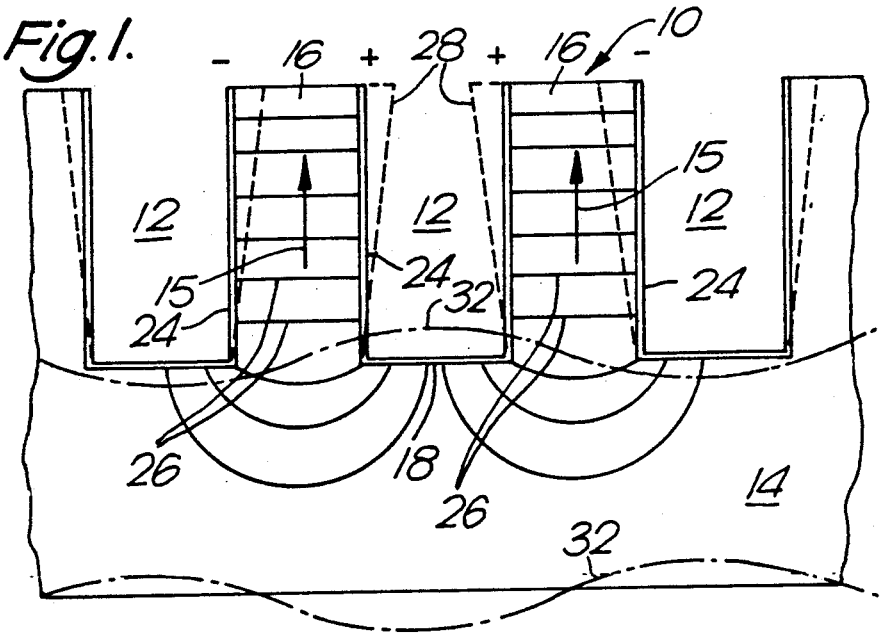
FIG. 1 is an enlarged fragmentary diagrammatic view of a high density, multi-channel array, electrically pulsed, droplet deposition apparatus in the form of an ink jet printhead which illustrates the problem addressed by the present invention.
Figure 2:
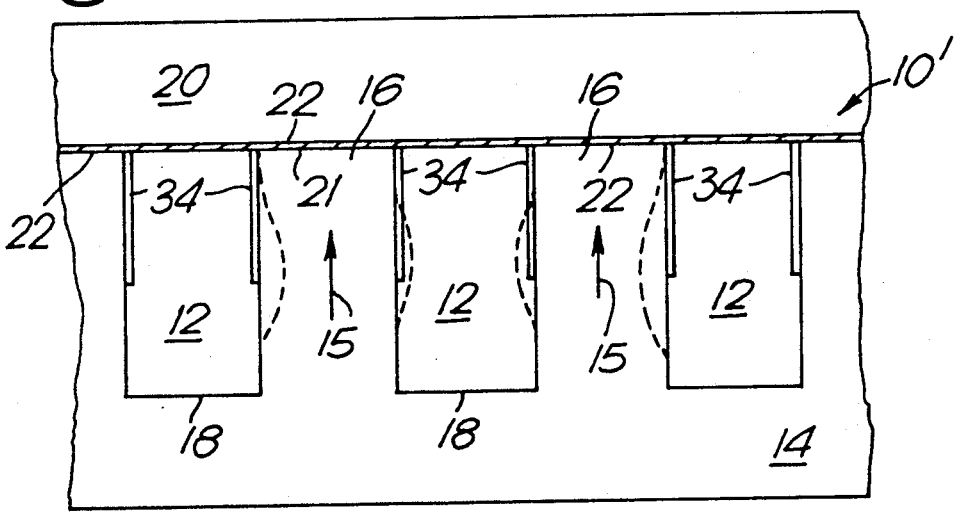
FIG. 2 is a view, similar to FIG. 1, showing an ink jet printhead according to the invention.

Referring to FIG. 1, an ink jet printhead 10 comprises a plurality of parallel ink channels 12 forming an array in which the channels are mutually spaced in an array direction perpendicular to the length of the channels. The channels are preferably formed at a density of two or more channels per mm in a sheet 14 of piezoelectric material. The piezoelectric material, preferably PZT, is poled in the direction of arrows 15. Each channel 12 is defined by a pair of side walls 16 and a bottom surface 18. The thickness of the PZT sheet 14 is preferably greater than the channel depth. The channels 12 are open topped and in the printhead are closed by a top sheet 20 of insulating material as shown in FIG. 2. Top sheet 20, which is omitted from FIG. 1 for clarity, is thermally matched to sheet 14 and is disposed parallel to the surfaces 18 and bonded by a bonding layer 21 to the tops 22 of the walls 16. The channels 12 are lined with a metalized electrode layer 24 on their side wall and bottom surfaces.

When potential differences of similar magnitude but of opposite polarity are applied to the electrodes on opposite faces of two adjacent walls 16, the walls will be subject to electric fields represented by the lines of flux density 26. These lines of flux density are normal to the poling direction 15 and are of opposite senses for the two adjacent walls 16. The walls 16 are consequently deflected in shear mode, and in the absence of a top sheet 20, are displaced to the positions indicated by the broken lines 28. However, at the roots of side walls 16 the electric fields 26 exhibit fringe effects such that the lines of flux density have substantial components in the direction of poling. When, as here, an electric field component is induced in a piezoelectric material in the direction of poling (i.e. the 3 direction), the material experiences an elongation or contraction both in the 3-3 direction along and in the 3-1 and 3-2 directions normal to the poling direction. This is in contrast to shear mode deflection which arises when the electric field in the 1 direction is perpendicular to the direction of poling such that the 1-5 deflection is rotational in character and is normal to both the field and the poling axis. This type of deflection is not accompanied by any change in the height or length of the side walls. The chain dotted lines 32 show that the fringe field lines cause a swelling of the piezoelectric material which is a maximum at the mid-channel location of those channels which are electrically activated and a contraction which is a maximum in the middle of those channels adjacent the activated channels.

In a printhead of the type described above, the channels may be arranged in two groups of odd and even numbered channels. Selected channels of each group are activated simultaneously and alternately with the channels of the other group. The fringe fields produced by the activated channels give rise to distortions in the base sheet 14. They reduce the shear mode deflection of walls 16 and generate piezoelectric stresses which are elastically propagated and develop crosstalk in the adjacent channels of the printhead.

The channels 12 may also be arranged in three or more groups of interleaved channels with selected channels of one group being simultaneously actuated in sequence with selected channels of the other groups. Whether arranged in two or more groups, a number of unactuated channels (at least one less than the number of channel groups) will be provided between actuated channels, thereby substantially reducing crosstalk. However, loss of shear mode wall deflection in the root of the walls remains significant.

FIG. 2 illustrates a printhead 10' modified in accordance with the present invention. The facing walls 16 of channels 12 of printhead 10' include metalized electrodes 34 which extend from the edges of the tops 22 of the walls down to a location well short of the bottom surface 18 of the channels. There is an optimum metallization depth which provides maximum wall displacement at about the mid-height of the walls depending on the distribution of wall rigidity. The virtue of this design is that the fringe fields damp out rapidly within the walls 16. Although the fringe fields generate stresses, no resultant deflection occurs in the walls. At the roots of walls 16 there are no fringe field components in the poling direction and therefore no distortion of the kind shown by the line 32 in FIG. 1 takes place.

Figure 3:
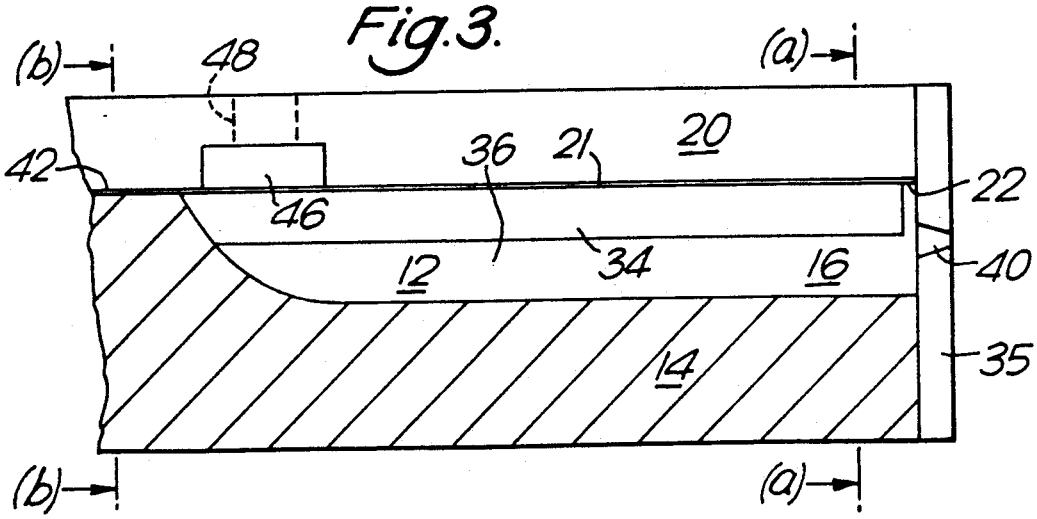
FIG. 3 is a fragmentary longitudinal sectional view of an ink channel of one form of ink jet printhead according to the invention.

Referring now to FIG. 3, according to another aspect of the invention, it will be seen that the channels 12 comprise a forward part 36 of uniform depth which is closed at its forward end by a nozzle plate 38 having formed therein a nozzle 40 from which droplets of ink in the channel are expelled by activation of the facing actuator walls 16 of the respective channel. The channel 12 rearwardly of the forward part 36 also has a part 42 extending from the tops 22 of walls 16 of lesser depth than the forward part 36. The metalized plating 34, which is on opposed surfaces of the walls 16, preferably occupies a depth approximately one half that of the channel side walls but greater than the depth of the channel part 42. Therefore, when plating takes place, the side walls 16 and bottom surface 18 of the channel part 42 are fully metalized while the side walls in the forward part 36 of the channel are metalized to approximately one half the channel depth. A suitable electrode metal which may be used for plating is an alloy of nickel and chromium, i.e. nichrome.

It has been found that for satifactory actuation of the actuator walls 16, the compliance of the bond layer 22, which may be expressed as hE/He, should be less than 1 and preferably greater than 0.1; where h is the height of the bond layer 22, e the modulus of elasticity of the layer, H the height of the walls 16 and E is the elastic modulus of the walls.

It will be noted that a liquid droplet manifold 46 is formed in the top sheet 20 transversely to the parallel channels 12. Manifold 46 communicates with each of the channels 12 and with a duct 48 which leads to liquid droplet supply (not shown).

Cutting of the channels 12 in sheet 14 may be effected in a number of different ways, including by means of grinding using a dicing cutter of the kind disclosed in copending application Ser. No. 246,225, filed Sept. 19, 1988, and entitled "Multi-Disc Cutter and Method of Manufacture." In accordance with this disclosure, a cutter rotating at a high speed is mounted above a movable bed to which a number of poled PZT sheets are secured. The bed is movable with respect to the horizontal rotary axis of the cutter. In particular, it is movable in a direction parallel to the horizontal rotary axis of the cutter and in two mutually perpendicular axes, a vertical axis and a horizontal axis, both forming right angles with the horizontal axis parallel with the cutter axis. The pitch of the cutter blades is greater than the pitch required for forming the channels 12 so that two or more passes of the cutter may be needed to cut the channels 12. At each cut, the forward channel sections 36 are first cut and the bed is then lowered so that the rearward sections 42 of the channels may be cut to a lesser depth as shown. The minimum concave radius at the rear end of sections 36 of the channels is determined by the radius of the cutter blades.

Figure 4B:
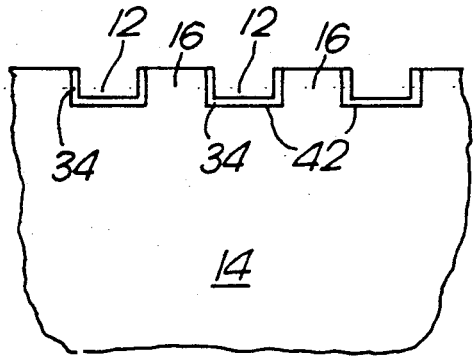
FIGS. 4(*a*) and 4(*b*) are fragmentary sectional views taken on the lines (a)—(a) and (b)—(b) of FIG. 3.
Figure 4A:
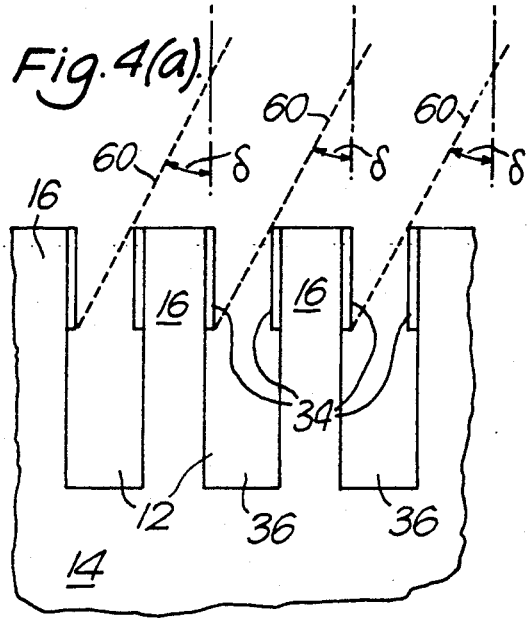

FIGS. 4(*a*) and 4(*b*) illustrate a preferred method of depositing the metal, preferably nichrome, electrodes 34. For this operation, a collimated beam 60 of evaporated metal atoms is derived from an electron beam which is directed on a metal source located about 0.5 to 1.0 meters from the jig holding the PZT sheets 14 in which the channels 12 have been cut. The PZT sheets 14 held in the jig are located with respect to the metal vapor beam so that the vapor emissions make an angle of + with the longitudinal vertical central plane of the channels 12 as shown. In this way, metal deposition takes place on one side wall 16 of each channel to a depth, determined by the angle d, which is approximately half the depth of section 36 of the channel, but greater than the depth of the channel rearward sections 42. In addition to coating the side walls 16 of channel sections 36, the corresponding walls in sections 42 together with greater part of the bottom surfaces of sections 42 are also coated at this time. A second stage of the coating process to complete the metal deposition is effected by turning the sheets 14 through 180 degrees so that the incident angle of the metal vapor is now −d. The walls 16 facing those previously coated are now treated along with the bottom surfaces of sections 42. Excess metal on the tops and ends of the channel walls may be removed by lapping. Instead of reversing the sheets 14, two sources of metal vapor may be used in succession to effect the metal coatings.

After the channels 12 have been plated and before they are connected to a suitable driver chip, an inert inorganic passivant is coated on the walls of the channel sections 36 and 42. The passivant coating is chosen to have a high electrical resistivity and to also be resistant to migration of ion species from the droplet fluid, in the case of a printer, the ink, to be employed, under the shear mode actuator field. A plurality of passivant layers may be needed to obtain the requisite electrical properties. Alternating films of Si3N4 and SiON are suitable for this purpose.

Figure 5:
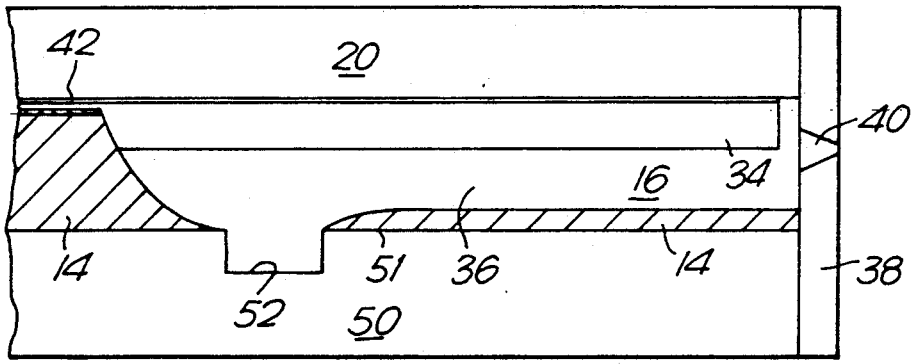
FIG. 5 is a view similar to FIG. 3, of another form of an ink jet printhead according to the invention.

FIG. 5 shows an alternate embodiment of the improved printhead of the invention in which a thinner sheet 14 of PZT is employed. Sheet 14 is laminated by a bond layer 51 to a base layer 50, preferably of glass thermally matched to sheet 14. Base layer 50 contains an ink manifold 52 communicating with channels 12 and with a source of droplet liquid supply. The channels 12 are formed a little less deep than the PZT sheet to help stiffen the bond layer 51 in the forward part 36, i.e. the active part of the channels.

Figure 6:
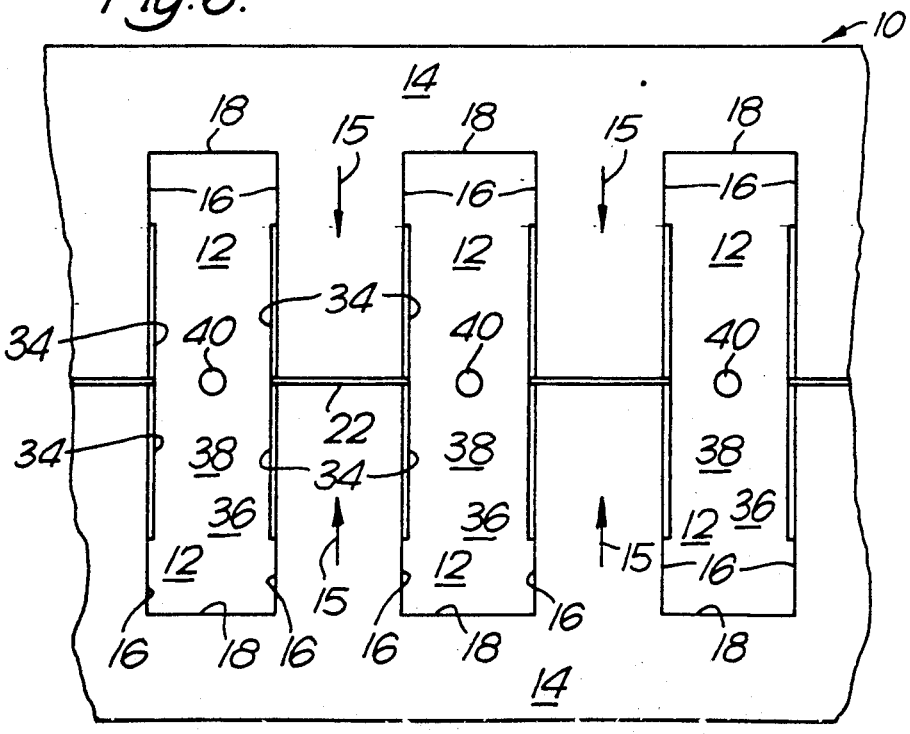
FIG. 6 is a view similar to FIG. 2 showing a further form of ink jet printhead according to the invention.

Referring now to FIG. 6, an embodiment of the invention is illustrated as applied to a printhead 10' of the form disclosed in FIGS. 2(*a*) to (*d*) of copending U.S. Pat. application Ser. No. 140,617. Printhead 10' comprises similar upper and lower sheets 14 of piezoelectric material formed with corresponding channels 12 which are provided with metalized electrodes 34. The upper and lower sheets 14 are secured together by inverting the upper sheet with respect to the lower sheet and providing a bond layer 22 between the tops of the corresponding channel side walls. In this form of actuator, the directions of poling 15 are opposed in the two sheets to cause the channel side walls to deflect in chevron configuration. In accordance with the invention, electrodes 34 stop short of the ends of channels 12 in both the upper and lower sheets 14 so that fringe field effects producing field components in the direction of poling are reduced, if not eliminated.

Figure 7:
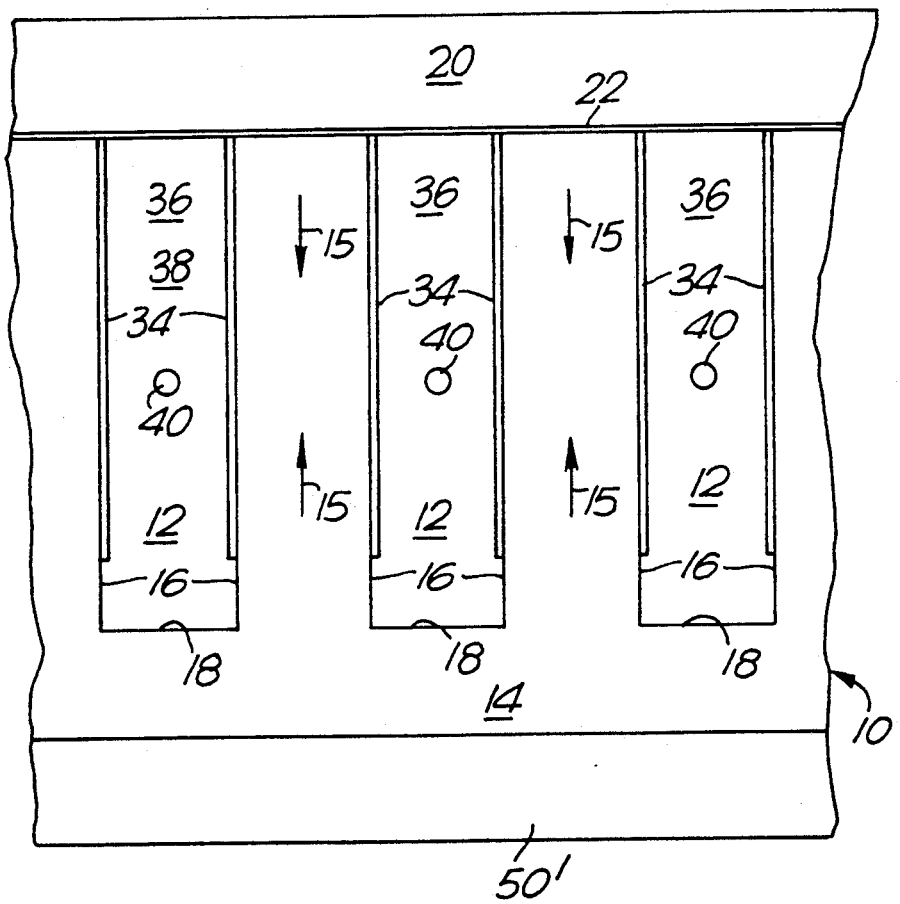
FIG. 7 is a view similar to FIGS. 2 and 6 showing yet another form ink jet printhead according to the invention.

In the embodiment illustrated in FIG. 7, a printhead 10'' includes a monolithic piezoelectric sheet 14 having upper and lower regions poled in opposite senses as indicated by the arrows 15. The electrodes 34 are deposited so as to cover the facing channel side walls from the tops thereof down to a short distance from the bottoms of the channels. In this manner, a region of each side wall extending from the top of the channel and poled in one sense and a substantial part of a lower region of the side wall poled in the reverse sense is covered by the relevant electrode. It will be appreciated that this arrangement operates to deflect the channel side walls into chevron form as in the case of the embodiment of FIG. 6. The chevron deflection in this case, however, occurs in a monolithic sheet of piezoelectric material rather than two such sheets bonded on or near the plane containing the channel axes. A method for poling monolithic sheets 14 transversely thereto with regions of opposed polarity at opposite sides of the sheet is described in copending U.S. Pat. application Ser. No. 246,559, filed Sept. 19, 1988.

Figure 8:
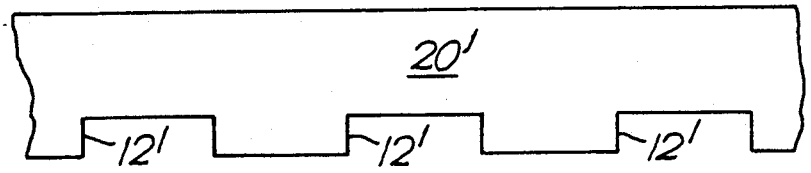
FIG. 8 is a view of an alternate embodiment of a component used in the printheads shown in FIGS. 2 and 7.

FIG. 8 illustrates a sheet 20' of insulating material which can be employed as an alternative to sheet 20 of the embodiments of the invention illustrated in FIGS. 2, 3, 5, 6 and 7. Sheet 20' is formed with shallow channels 12' which correspond to the channels 12 of sheet 14 and is bonded after inversion thereof to the sheet 14, the bond layer 22 being formed between the tops of the corresponding channel side walls in the sheets 14 and 20'.

It is recognized that numerous changes and modifications may be made in the desired embodiments of the invention without departure from its true spirit and scope. The invention is therefore only to be limited as defined in the claims.

What is claimed is:

1. A high density multi-channel array electrically pulsed droplet deposition apparatus, comprising a sheet of piezoelectric material poled in a direction normal to said sheet and formed with a plurality of parallel channels mutually spaced in an array direction normal to the length of said channels, each channel being defined by facing side walls and a bottom surface extending between the respective side walls, each of at least some of said side walls including electrodes on opposite sides thereof to form shear mode actuators for effecting droplet expulsion from the channels associated with the actuators, each electrode extending substantially along the length of the corresponding side wall and over an area so spaced from the bottom surface of the channel in which the electrode is disposed as to leave the portion of said sheet adjacent said bottom surface substantially free from piezo-electric distortion when an electric field is applied across the electrodes of the associated wall.

2. The apparatus of claim 1 including a top sheet facing said bottom surfaces of said channels and bonded to said side walls to close said channels at the tops thereof and wherein each of said electrodes extends over an area of the side wall on which it is provided from the edge of said side wall adjoining said top sheet.

3. The apparatus of claim 2 wherein said area is of rectangular shape.

4. The apparatus of claim 2 including respective nozzles formed adjacent one end of said channels and communicating therewith for the ejection of droplets of liquid therefrom and wherein each of said electrodes extends from the end of said channels adjacent said nozzles.

5. The apparatus of claim 2 wherein each of said channels is formed with a forward part of uniform depth between said bottom surface and said top sheet in which said electrodes are provided and a part rearwardly of said forward part of lesser depth than said forward part.

6. The apparatus of claim 5 wherein the electrodes provided on the facing walls of each of said forward parts have a depth which is greater than the depth of said rearward parts but less than the depth of said channels.

7. The apparatus of claim 6 wherein each of said rearward parts is formed with an interior electrically conductive coating which is in electrical contact with the electrodes on the facing side walls of the forward parts of said channels.

8. The apparatus of claim 7 wherein the electrodes on the facing walls of said forward parts of said channels are integrally formed with the electrically conductive coatings on the channel parts rearwardly of said forward parts.

9. A high density multi-channel array, electrically pulsed droplet deposition apparatus, comprising a bottom sheet of piezoelectric material poled in a direction normal to said sheet and formed with a plurality of parallel, open-topped channels mutually spaced in an array direction normal to the length of said channels, each channel being defined by facing side walls and a bottom surface extending between the respective side walls, a top sheet facing said bottom surfaces of said channels and bonded to said side walls to close said channels at the tops thereof, each of said channels being further formed with a forward part of uniform depth between said bottom surface and said top sheet and a part rearwardly of said forward part of lesser depth than said forward part, each of at least some of said side walls of said forward parts including electrodes on opposite sides thereof to form shear mode actuators for effecting droplet expulsion from the channels associated with the actuators, each electrode extending substantially along the length of the corresponding side wall and over an area from the edge of said side wall adjoining said top sheet which is so spaced from the bottom surface of the channel in which the electrode is disposed as to leave the portion of said bottom sheet adjacent the wall on which said electrode is provided substantially free from piezo-electric distortion when an electric field is applied across the electrodes of the associated wall.

10. The apparatus of claim 9 wherein each of said rearward parts is formed with an interior electrically conductive coating which is in electrical contact with said electrodes on the facing side walls of the forward parts of said channels.

11. The apparatus of claim 10 wherein the electrodes provided on the facing walls of each of said forward parts have a depth greater than the depth of said rearward parts but less than the depth of said channels.

12. A high density multi-channel array, electrically pulsed droplet deposition apparatus, comprising a sheet of piezoelectric material poled in a direction normal to said sheet and formed with a plurality of parallel channels mutually spaced in an array direction normal to the length of said channels, each channel being defined by facing side walls and a bottom surface extending between the respective side walls, each of at least some of said side walls including electrodes on opposite sides thereof to form shear mode actuators for effecting droplet expulsion from the channels associated with the actuators, each electrode extending over an area of the corresponding side wall which is spaced from the bottom surface of the channel in which the electrode is disposed for minimizing the creation of fringe fields in the portion of said sheet adjacent said bottom surface when an electric field is applied across the electrodes of the associated wall.

13. The apparatus of claim 12 including a top sheet facing said bottom surfaces of said channels and bonded to said side walls to close said channels at the tops thereof and wherein each of said electrodes extends over an area of the side wall on which it is provided from the edge of said side wall adjoining said top sheet.

14. The apparatus of claim 13 wherein each of said channels is formed with a forward part of uniform depth between said bottom surface and said top sheet in which said electrodes are provided and a part rearwardly of said forward part of lesser depth than said forward part.

15. The apparatus of claim 14 wherein the electrodes provided on the facing walls of each of said forward parts have a depth which is greater than the depth of said rearward parts but less than the depth of said channels.

* * * * *